US007050889B2

(12) United States Patent
Bonilla et al.

(10) Patent No.: US 7,050,889 B2
(45) Date of Patent: May 23, 2006

(54) METHOD AND SYSTEM FOR A COMPUTER CONTROLLED RACING NETWORK

(75) Inventors: Victor G. Bonilla, Scottsdale, AZ (US); James W. McCabe, Scottsdale, AZ (US)

(73) Assignee: Racing Visions Investments Inc., Scottsdale, AZ (US)

( * ) Notice: Subject to any disclaimer, the term of this patent is extended or adjusted under 35 U.S.C. 154(b) by 46 days.

(21) Appl. No.: 10/420,227

(22) Filed: Apr. 21, 2003

(65) Prior Publication Data

US 2003/0233449 A1 Dec. 18, 2003

Related U.S. Application Data

(60) Provisional application No. 60/374,440, filed on Apr. 22, 2002.

(51) Int. Cl.
*G06F 19/00* (2006.01)
*A63F 9/24* (2006.01)

(52) U.S. Cl. ..... 701/1; 701/2; 701/33; 701/35; 463/42; 709/224

(58) Field of Classification Search ..... 701/1, 701/2, 24, 93, 200, 33, 35; 703/22; 463/42, 463/59; 709/224; 446/454
See application file for complete search history.

(56) References Cited

U.S. PATENT DOCUMENTS 4,334,221 A * 6/1982 Rosenhagen et al. ..... 463/6
4,817,948 A * 4/1989 Simonelli ..... 463/6
4,857,886 A * 8/1989 Crews ..... 340/323 R
4,986,187 A 1/1991 Booth et al. ..... 104/84
5,015,189 A 5/1991 Wenzinger, Jr. ..... 434/63
5,016,004 A 5/1991 Funk et al. ..... 340/825.69
5,044,956 A 9/1991 Behensky et al. ..... 434/45
5,338,247 A 8/1994 Miles ..... 446/456
5,366,376 A * 11/1994 Copperman et al. ..... 434/69
5,456,604 A 10/1995 Olmsted et al. ..... 434/62
5,481,257 A 1/1996 Brubaker et al. ..... 340/825.69
5,596,319 A 1/1997 Spry ..... 340/903
5,707,237 A 1/1998 Takemoto et al. ..... 434/69
5,816,920 A * 10/1998 Hanai ..... 463/42
5,921,780 A * 7/1999 Myers ..... 434/69
5,989,096 A 11/1999 Barton et al. ..... 446/425
6,074,271 A 6/2000 Derrah ..... 446/457

(Continued)

FOREIGN PATENT DOCUMENTS

GB 2 128 842 5/1984

*Primary Examiner*—Tan Q. Nguyen
(74) *Attorney, Agent, or Firm*—Kunzler & Associates

(57) ABSTRACT

A method and system for computer controlled racing over a network are disclosed. The network comprises at least one vehicle to be controlled and a remote user station. A server may also be incorporated and provided with a user profile database containing user profiles and a user racing history. Users may be ranked and assigned vehicle performance profiles depending upon their performance. The server further includes a track marshal module configured to monitor vehicle usage and may be configured to override a vehicle during erratic vehicle behavior. The server is also provided with a behavior module that may allow the server to initialize a vehicle according to a user profile. The vehicle is provided with a vehicle control module configured to communicate with the server over a wireless or wired network using network switched packets containing vehicle control data. The server may also communicate with a user control station in a similar manner.

21 Claims, 9 Drawing Sheets

U.S. PATENT DOCUMENTS 6,113,459 A 9/2000 Nammoto ..... 446/454
6,141,145 A 10/2000 Nalwa ..... 395/403
6,155,928 A * 12/2000 Burdick ..... 463/46
6,247,994 B1 6/2001 DeAngelis et al. ..... 446/454
6,309,306 B1 10/2001 Geagley et al. ..... 472/60
6,508,710 B1 * 1/2003 Paravia et al. ..... 463/42
6,632,138 B1 * 10/2003 Serizawa et al. ..... 463/6
2001/0026386 A1 10/2001 Yamamoto et al. ..... 359/142
2001/0045978 A1 11/2001 McConnell et al. ..... 348/42
2002/0107072 A1 * 8/2002 Giobbi ..... 463/42

* cited by examiner

METHOD AND SYSTEM FOR A COMPUTER CONTROLLED RACING NETWORK

BACKGROUND OF THE INVENTION

1. Related Applications

This application is a Continuation-In-Part of and claims priority to U.S. Provisional Patent Application Ser. No. 60/374,440 filed on Apr. 22, 2002 for Racing Visions, L.L.C.

2. The Field of the Invention

The invention relates to remotely controlling vehicles over a network and, more specifically, to providing centralized communication with a plurality of remotely controlled vehicles over a data network.

3. The Relevant Art

Remotely controlling scaled vehicles has been a popular hobby for many years. Children and adults are fascinated by the opportunity to control vehicles that normally are not available for use, such as military vehicles or trains. Scale replicas of racecars, boats, submarines, dune buggies, monster trucks, and motorcycles are among the vehicles that are widely available for remote control enthusiasts.

Modelers and manufacturers of scaled vehicles put forth considerable time and effort to attain a scaled vehicle with a life-like appearance. For many, great pleasure is derived from controlling a realistically scaled vehicle. Many methods have been developed to control scaled vehicles. Control mechanisms exist that utilize a physical connection, such as a cable, between the vehicle and the controller. This simple control mechanism is relatively inexpensive and easy to implement but requires that the user follow the vehicle. To overcome these limitations, radio control, or R/C, mechanisms have been developed.

Radio controllers facilitate the control of a vehicle through radio transmissions. By breaking the physical link between the vehicle and controller, R/C enthusiasts are able to participate in organized group events such as racing or with friends in what is known as "backyard bashing." Additionally, R/C controllers have allowed scaled vehicles to travel over and under water, and through the air, which for obvious reasons was not previously possible with a cabled control mechanism.

Racing scaled versions of NASCAR™, Formula 1™, and Indy™ series racecars has become very popular because, unlike other sports, the public generally does not have the opportunity to race these cars. Although scaled racecars give the hobbyist the feeling of racing, for example, a stock car, remotely racing a scaled racecar may lack realism. In order to make a racecar visually interesting to the point of view of the racer, the racecar is normally operated at speeds that if scaled are unrealistic. Additionally R/C is limited by the amount of channels or frequencies available for use. Currently, operators of racing tracks or airplane parks must track each user's frequency and when all of the available channels are being used, no new users are allowed to participate.

A solution to this problem has been to assign a binary address to each vehicle in a system. Command data is then attached to the binary address and transmitted to all vehicles in the system. In an analog R/C environment, commands to multiple vehicles must be placed in a queue and transmitted sequentially; this presents a slight lag between a user control and response by the vehicle. Each vehicle constantly monitors transmitted commands and waits for a command with the assigned binary address. Limitations to this system include the loss of fine control of vehicles due to transmit lag, and ultimately the number of vehicles is limited because the time lag could become too great.

Accordingly, an apparent need exists for a system and method of remotely controlling a plurality of scaled vehicles over a data network. Beneficially, the proposed system and method would allow multiple vehicle operators to utilize the data network for control signal transmissions as well as for storing user profiles particular to each vehicle operator.

BRIEF SUMMARY OF THE INVENTION

The present invention has been developed in response to the present state of the art, and in particular, in response to the problems and needs in the art that have not yet been fully solved by currently available racing systems. Accordingly, the present invention has been developed to provide a computer controlled racing network that overcomes many or all of the above-discussed shortcomings in the art.

In accordance with the invention as embodied and broadly described herein in the preferred embodiments, an improved racing system is provided and configured to operate over a network. The racing system comprises at least one network interface connection and a server configured to communicate with a central processing unit of a vehicle over the network.

Additionally, the racing system comprises a user profile database residing within the server, and a plurality of user profiles residing within the user profile database. In one embodiment, the user profile comprises a user name, a race history, a skill level based upon the race history, and a vehicle performance profile. The racing system may also comprise a track marshal module operating within the server and configured to adjust vehicle performance dynamically, and override a user and safely control the vehicle.

In one embodiment, the racing system may comprise a behavior module operating within the server and configured to assign the user profile to a vehicle, assign the user to a position in a starting lineup of a race, and adjust the performance of the vehicle according to the skill level of the user.

The racing system may also comprise a vehicle controllable to move in a direction selectable remotely by a user. In one embodiment, the vehicle comprises a chassis configured to move about in response to vehicle control data from a user, a controller residing within the chassis configured to receive network switched packets containing the vehicle control data, and an actuator interface module configured to operate an actuator in response to the vehicle control data received by the controller. The controller may be configured to transmit vehicle data feedback to a user through a wireless network interface connection. Additionally, the controller may be configured to transmit visual data to the user, or transmit a 360° three dimensional view to the user.

In one embodiment, the racing system comprises a station from which a vehicle is remotely controlled. The station may comprise a vehicle control configured to generate vehicle control data in response to input from a user, and a transmission module configured to communicate with the vehicle control and transmit network switched packets containing the vehicle control data over a transmission medium to the vehicle. The transmission module may comprise a central processing unit and a network interface connection, the central processing unit configured to communicate with the network interface connection.

The racing system may also comprise a control apparatus for a vehicle controllable remotely over a network. In one embodiment, the control apparatus comprises a network interface connection configured to transmit and receive vehicle control data, a central processing unit configured to provide vehicle control data to the network interface connection, and an actuator interface module configured to receive vehicle control data from the central processing unit. Preferably, the control apparatus further comprises a video interface module configured to communicate visual data to the central processing unit, and a plurality of video cameras configured to provide visual data to the video interface module.

Additionally, the control apparatus may also comprise a Simple Network Management Protocol (SNMP) interface module residing within the central processing unit configured to operate an actuator.

A method of computer controlled racing over a network is also provided. In one embodiment, the method comprises providing a mobile vehicle configured to transmit and receive vehicle control data over a network, providing a server configured to transmit and receive vehicle control data, checking a user profile, assigning a performance profile to the vehicle, assigning a position to a user within the starting lineup of a plurality of racing vehicles, transmitting vehicle control data, controlling the mobile vehicle in response to the transmitted vehicle control data, receiving vehicle feedback data from the vehicle, recording racing statistics in a database, and updating a user identification card.

In one embodiment, the racing system may also comprise a computer usable medium readable by a computer, tangibly embodying a program of instructions executable by a computer to perform method steps for computer controlled racing over a network.

These features and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Figure 1:
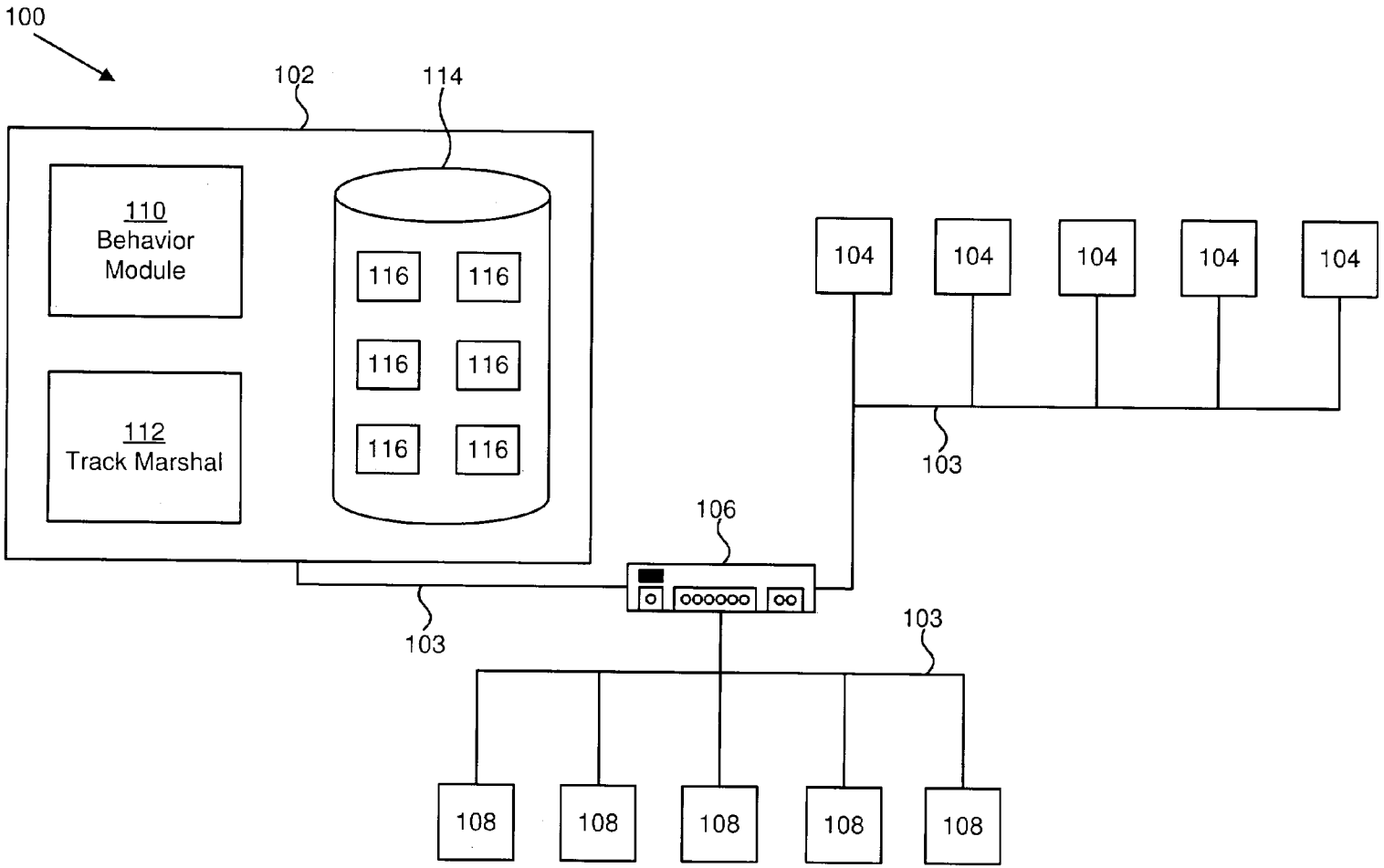
FIG. 1 is a schematic block diagram illustrating one embodiment of a computer controlled racing system in accordance with the present invention.

FIG. 1 shows one embodiment of a computer controlled racing network 100 that may be implemented for communicating with a vehicle operated remotely. The network 100 includes a server 102, one or more data channels 103, one or more interface (UI) modules 104, a router 106, and one or more vehicle control modules 108. Alternately, the network 100 may be configured to accommodate a single UI module 104 or a single vehicle control module 108. Using inherent characteristics of the illustrated network 100, the distinct vehicle control modules 108 need not communicate on different frequencies. By implementing the racing system as a racing network 100 as illustrated, each vehicle control module 108 may be provided with a different address and thus seen as a separate device on the network 100, thereby overcoming many limitations of the prior art with regard to the quantity of users that can race simultaneously.

In one embodiment the data channel 103 comprises a standard Ethernet network. The configuration of the network 100 given herein is by way of example and other configurations as implemented by one skilled in the art may maintain the intention and functionality of the network 100.

The depicted server 102 includes a behavior module 110, a track marshal module 112, and a user profile database 114. In one embodiment, the behavior module 102 is configured to assign a user's vehicle to a position in a starting lineup of a race. The user's vehicle will be described further with reference to FIG. 3. Additionally, the position assigned in the starting lineup may be determined by the past performance of the user. For example, in a race with multiple users, the user with the best past performance may be assigned the first position, also known as the pole position, in the starting lineup.

The behavior module 110 may also be configured to adjust the user's performance level with the vehicle. In one embodiment, the behavior module 110 may assign a performance limit to the vehicle according to the past performance of a user. For example, if a user has a history of damaging or dangerous behavior with the vehicle, the behavior module 110 may limit the top speed and or cornering ability of the vehicle. In one embodiment, the performance limit is stored in the user profile database and transmitted via the corresponding vehicle control module 108 to the vehicle servos that the vehicles performance parameters, such as control speed, effectively tuning down the vehicle. The vehicle control module 108 will be discussed in greater detail with respect to FIG. 5.

Initially, the performance of a vehicle may be limited by the behavior module 110 in order to minimize accidents. As a user progresses, the behavior module 110 in one embodiment increases the availability of higher performance levels to the user until a maximum scaled performance level is achieved. Additionally, the behavior module 110 may update a user profile record 116 stored within the user profile database 114.

The track marshal module 112 is configured in one embodiment to dynamically monitor the status of one or more racing vehicles. The track marshal module 112 may be configured to override the user control of a vehicle if erratic driving is detected. For example, an administrator (not shown) may watch the race and in the event that the administrator views abusive or dangerous behavior from a user, the administrator may override communications with the vehicle control module 108 of the identified vehicle.

Figure 2A:
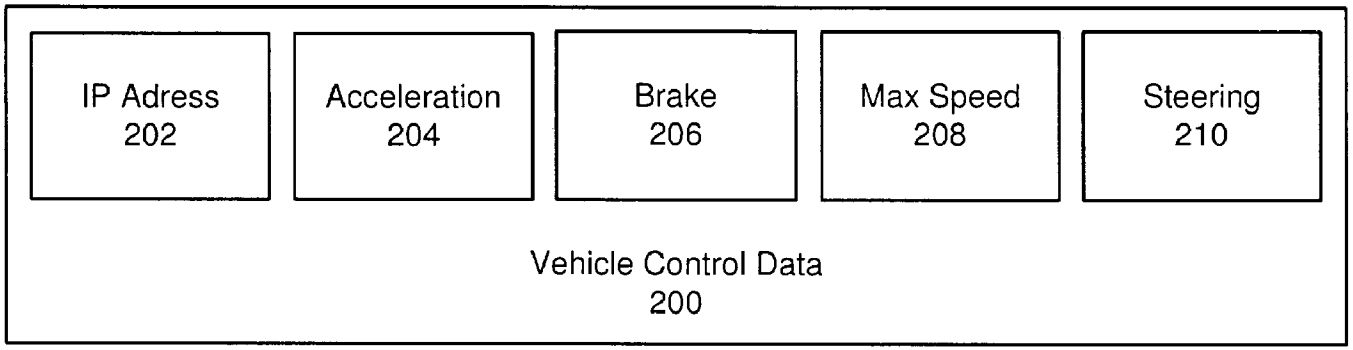
FIG. 2*a* is a schematic block diagram illustrating one embodiment of a vehicle control data packet in accordance with the present invention.

FIG. 2*a* illustrates one embodiment of vehicle control data 200. Under a preferred embodiment of the present invention, the vehicle control data 200 may comprise one or more network switchable packets. Preferably, the vehicle control data 200 contains an internet protocol (IP) address 202, an acceleration setting 204, a brake setting 206, a maximum speed setting 208, and a steering setting 210. Of course, not all of this data need be present and additional data may also be transmitted in the described packets. The IP address 202 enables correct routing of the vehicle control data 200 between a user and a vehicle 300 which will be described in greater detail below with respect to FIG. 3. IP addressing and the details thereof are well known to those skilled in the art.

In one embodiment a single packet of vehicle control data 200 may contain various setting data including, for example, the acceleration setting 204, the brake setting 206, the maximum speed setting 208, and the steering setting 210. Alternatively, each vehicle control data 200 packet may contain only one setting to be updated. The manner in which the vehicle control data 200 is utilized will be discussed in greater detail below.

Figure 2B:
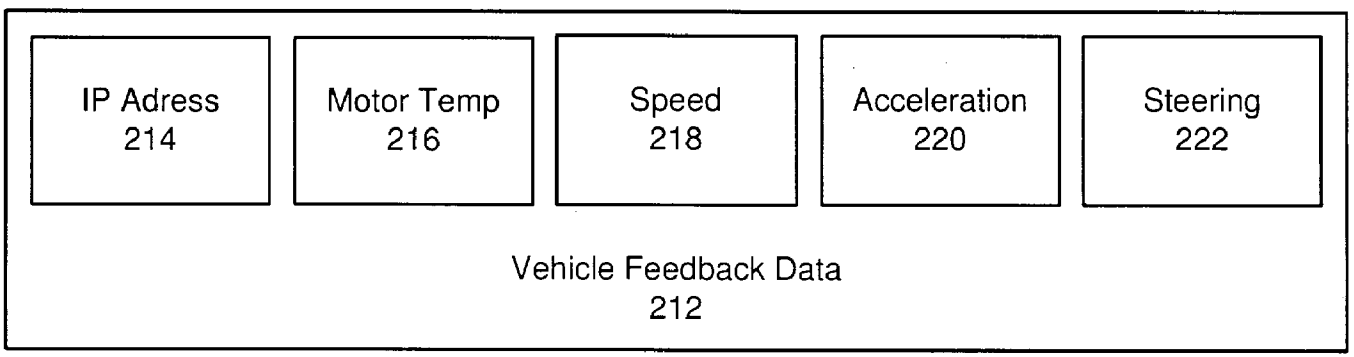
FIG. 2*b* is a schematic block diagram illustrating one embodiment of a vehicle feedback data packet in accordance with the present invention.

Referring now to FIG. 2*b*, shown therein is one embodiment of vehicle feedback data 212. The vehicle feedback data 212 is configured in a manner substantially equivalent to the vehicle control data 200. In one embodiment, the vehicle feedback data 212 contains at least an IP address 214. Alternatively, the vehicle feedback data 212 comprises one or more of a motor temperature 216, a speed 218 at which the vehicle 300 is traveling, an acceleration 220 of the vehicle 300, and a steering position 222. In alternative embodiments, the settings 216, 218, 220, and 222 may comprise a list of environmental variable of the vehicle 300 as selected by a user.

The manner of controlling a vehicle remotely over a network may be implemented collectively, with a plurality of vehicles operating on a single network, or may be implemented in a peer-to-peer configuration, with a single vehicle and a single controller, each communicating with a network protocol. When operating with a plurality of vehicles, a server may be used, as disclosed herein in certain embodiments, but it should be readily recognized that the control of a vehicle remotely over a network need not necessarily involve a server. Likewise, it is preferred that the network communications involve packetized communications as described above, but, of course, any type of networked communications may be involved.

Figure 3:
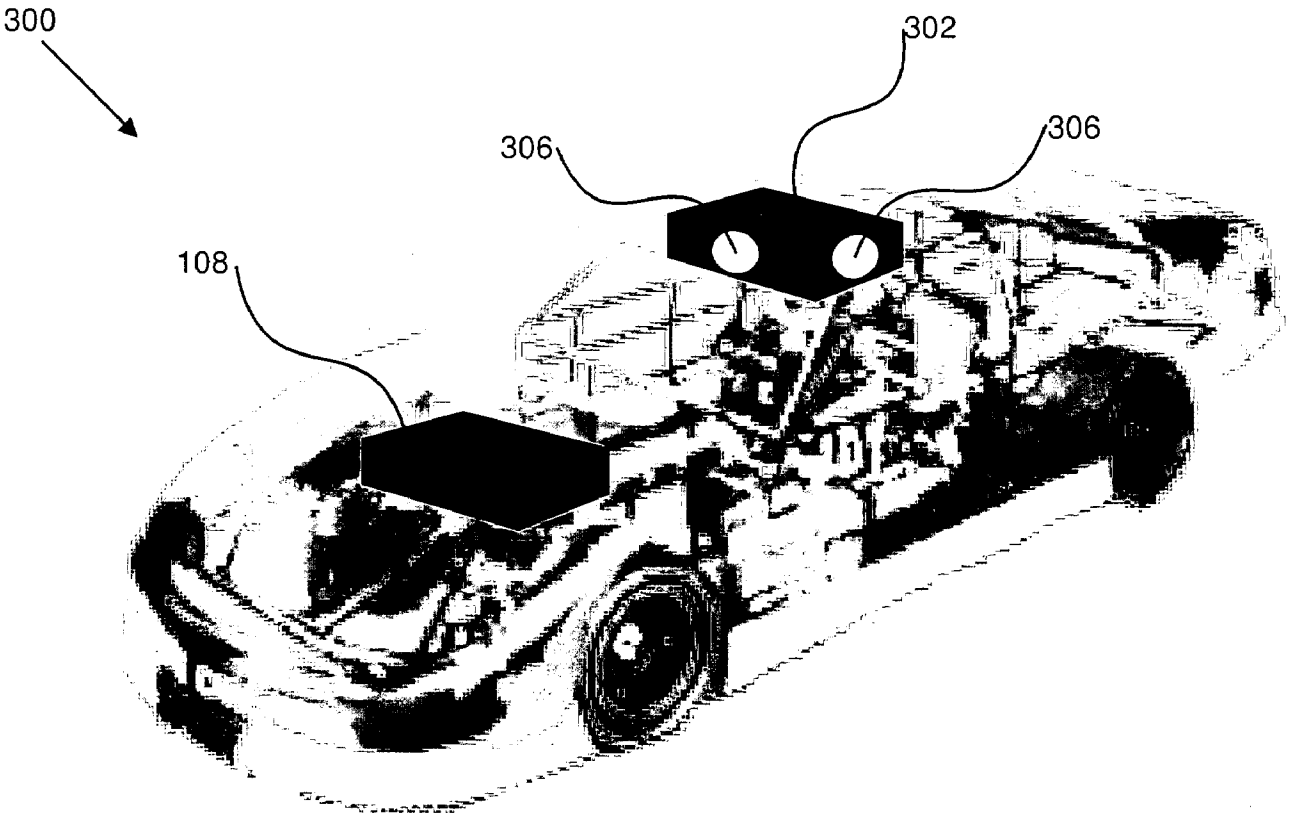
FIG. 3 is a perspective view of a one embodiment of a computer controlled racing vehicle in accordance with the present invention.

FIG. 3 shows a vehicle 300 that is controllable over a network. As depicted, the vehicle includes a video camera module 302 and a vehicle control module 108. The vehicle 300 is in one embodiment replicated at one-quarter scale, but may be of other scales also, including one-tenth scale, one-fifth scale, and one third-scale. Additionally, the network controlled vehicle 300 may embody scaled versions of airplanes, monster trucks, motorcycles, boats, buggies, and the like. In one embodiment, the vehicle 300 is a standard quarter scale vehicle 300 with centrifugal clutches and gasoline engines. Alternatively, the vehicle 300 may be electric or liquid propane or otherwise powered. Quarter scale race cars are available from New Era Models of Nashua, N.H. as well as from other vendors, such as Danny's ¼ Scale Cars of Glendale Ariz.

The vehicle 300 is operated by remote control, and in one embodiment an operator need not be able to see the vehicle 300 to operate it. Rather, a video camera module 302 is provided with one or more cameras 306 connected to the vehicle control module 108 for displaying the points of view of the vehicle 300 to an operator. The operator may operate the vehicle 300 from a remote location at which the operator receives vehicle control data and optionally audio and streaming video. In one embodiment, the driver receives the vehicle control data over a local area network. Under a preferred embodiment of the present invention, the video camera module 302 is configured to communicate to the operator using the vehicle control module 108. Alternatively, the video camera module 302 may be configured to transmit streaming visual data directly to an operator station.

An operator station may be provided that simulates the inside of the vehicle being operated remotely. The operator station may, for example, resemble a race car, and a screen or a plurality of screens may be used to display various views from the race car. Controls such as a steering wheel, gear shift, clutch, brakes, etc for controlling the race car may be used within the operator station and translated to digital signals for transmission to the vehicle 300. Feedback may be provided to a user, including temperature, speed, oil pressure, and the like. The feedback may be provided in a single display, or with separate dials.

In one embodiment, the operator station is mounted on a motion simulator. The motion simulator may be coordinated with sensors such as speed and brake sensors and gyros within the vehicle. The operator station may be caused to move forward and back, yaw and roll, in response to the signals from the motion simulators. Other sensors and actuators may also be provided, even including smell dispensers resembling the smell within the vehicle.

Figure 4A:
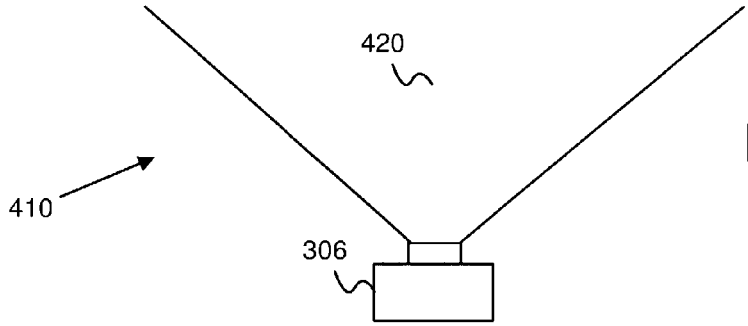
FIG. 4*a* is a schematic block diagram illustrating one embodiment of a two dimensional video camera module in accordance with the present invention.

FIG. 4*a* depicts a plan view 410 of a single camera 306 that may be mounted to the vehicle 300 as discussed in conjunction with FIG. 3. The depicted camera 306 has a specific field of view 420, delineated by a pair of the angled solid lines that is determined by the design and manufacture of the camera 306. In one embodiment, the field of view 420 is fixed and, in an alternate embodiment, the field of view 420 of the camera 306 may be dynamically adjusted using either optical or digital processes. The field of view 420 captured by the illustrated camera 306 generally produces a two dimensional image.

Figure 4B:
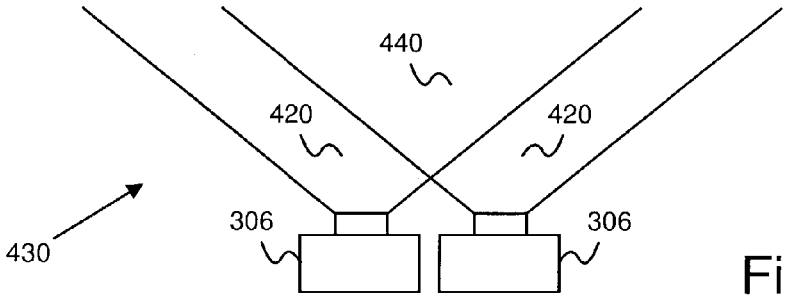
FIG. 4*b* is a schematic block diagram illustrating one embodiment of a three dimensional video camera module in accordance with the present invention.

FIG. 4*b* illustrates a plan view 430 of a pair of cameras 306 that may be co-mounted to the vehicle 300. As in the previous figure, each depicted camera 306 has a specific field of view 420. Similarly, the field of view 420 of each camera 306 in the pair may be fixed or dynamically adjustable. According to the mounting configuration, including the relational orientation of the pair of cameras 306, the fields of view 420 may wholly or partially overlap. The video camera module 302 may then process the combination of captured fields of view 420 and create a three dimensional image.

Figure 4C:
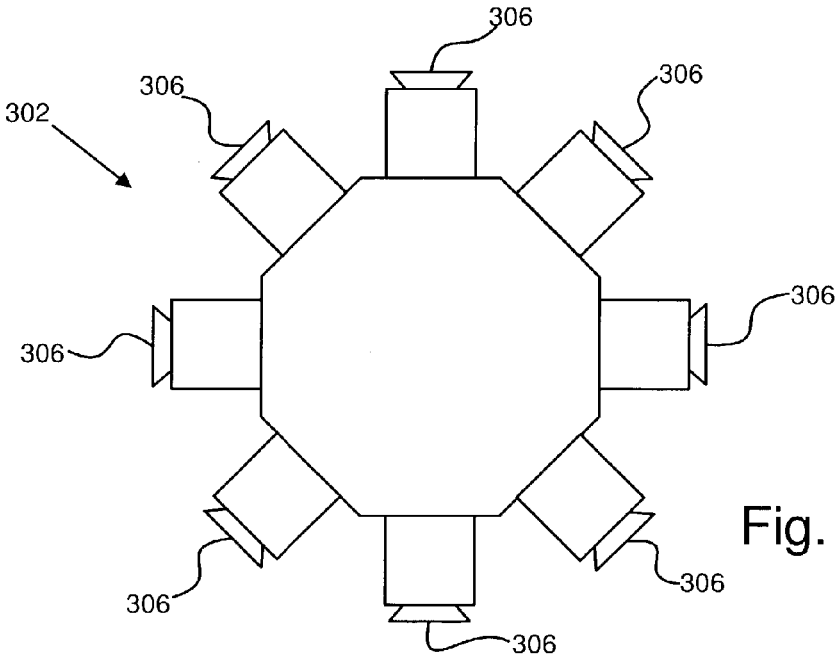
FIG. 4*c* is a schematic block diagram illustrating one embodiment of a 360° three dimensional video camera module in accordance with the present invention.

Referring now to FIG. 4*c*, shown therein is one embodiment of the video camera module 302. The illustrated video camera module 302 includes a plurality of video cameras 306. The cameras 306 may be mounted in a circular manner so as to provide a combined panoramic view created from the plurality of corresponding fields of view 420. One advantage of the present invention is the ability to form a two dimensional, three dimensional, or 360° three dimensional image. The video camera module 302 is preferably configured to weave together the overlapping fields of view 420 of each camera 306. As discussed in conjunction with FIG. 4*b*, a three dimensional view is possible by processing two overlapping fields of view 420. In one embodiment, each camera 406 may be oriented to allow overlap of the fields of view 420 of the two cameras 106 that are closest.

Figure 5:
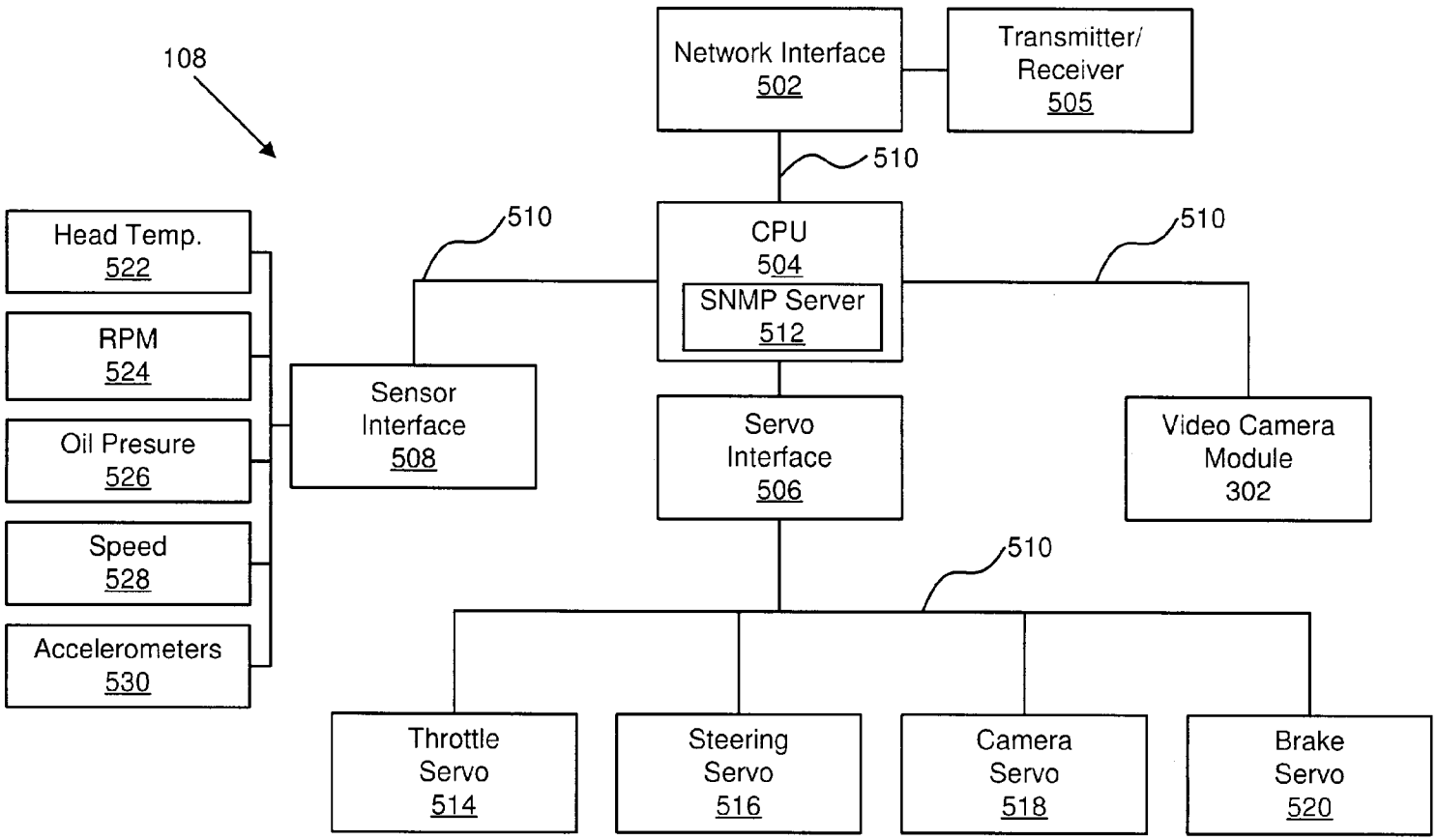
FIG. 5 is a schematic block diagram illustrating one embodiment of a vehicle control module in accordance with the present invention.

FIG. 5 shows one embodiment of the vehicle control module 108. The vehicle control module 108 in one embodiment includes a network interface module 502, a central processing unit (CPU) 504, a servo interface module 506, a sensor interface module 508, and the video camera module 302. In one embodiment, the network interface module 502 is provided with a wireless transmitter and receiver 505. The transmitter and receiver 505 may be custom designed or may be a standard, off-the-shelf component such as those found on laptops or electronic handheld devices. Indeed, a simplified computer similar to a Palm™ or Pocket PC™ may be provided with wireless networking capability, as is well known in the art, and placed in the vehicle 300 for use as the vehicle control module 108.

In one embodiment of the present invention, the CPU 504 is configured to communicate with the servo interface module 506, the sensor interface module 508, and the video camera module 302 through a data channel 510. The various controls and sensors may be made to interface through any type of data channel 510 or communication ports, including PCMCIA ports. The CPU 504 may also be configured to select from a plurality of performance levels upon input from an administrator received over the network. Thus, an operator may use the same vehicle 300 and may progress from lower to higher performance levels. The affected vehicle 300 performance may include in one embodiment steering sensitivity, acceleration, and top speed. This is especially efficacious in driver education and training applications. The CPU 504 may also provide a software failsafe with limitations to what an operator is allowed to do in controlling the vehicle 300.

In one embodiment the CPU 504 comprises a Simple Network Management Protocol (SNMP) server module 512. SNMP provides an extensible solution with low computing overhead to managing multiple devices over a network. SNMP is a well known to those skilled in the art. In an alternate embodiment not depicted, the CPU 504 may comprise a web-based protocol server module configured to implement a web-based protocol, such as Java™, for network data communications.

The SNMP server module 512 is configured in one embodiment to communicate vehicle control data 200 to the servo interface module 506. The servo interface module 506 communicates the vehicle control data 200 with the corresponding servo. For example, the network interface card 502 receives vehicle control data 200 that indicates a new position for a throttle servo 514. The network interface card 502 communicates the vehicle control data 200 to the CPU 504 which passes the data 200 to the SNMP server 512. The SNMP server 512 receives the vehicle control data 200 and routes the setting that is to be changed to the servo interface module 506. The servo interface module 506 then communicates a command to, for example, the throttle servo 514 to accelerate or decelerate.

The SNMP server 512 is configured to control a plurality of servos through the servo interface module 506. Examples of servos that may or may not be present in the vehicle 300, depending upon the type of vehicle 300, are a throttle servo 514, a steering servo 516, a camera servo 518, and a brake servo 520. Additionally, the SNMP server 512 may be configured to retrieve data by communicating with the sensor interface module 508. Examples of some desired sensors for a gas vehicle 300 are shown in FIG. 5 and include a head temperature sensor 522, an RPM sensor 524, an oil pressure sensor 526, a speed sensor 528, and an acceleration sensor 530.

Figure 6:
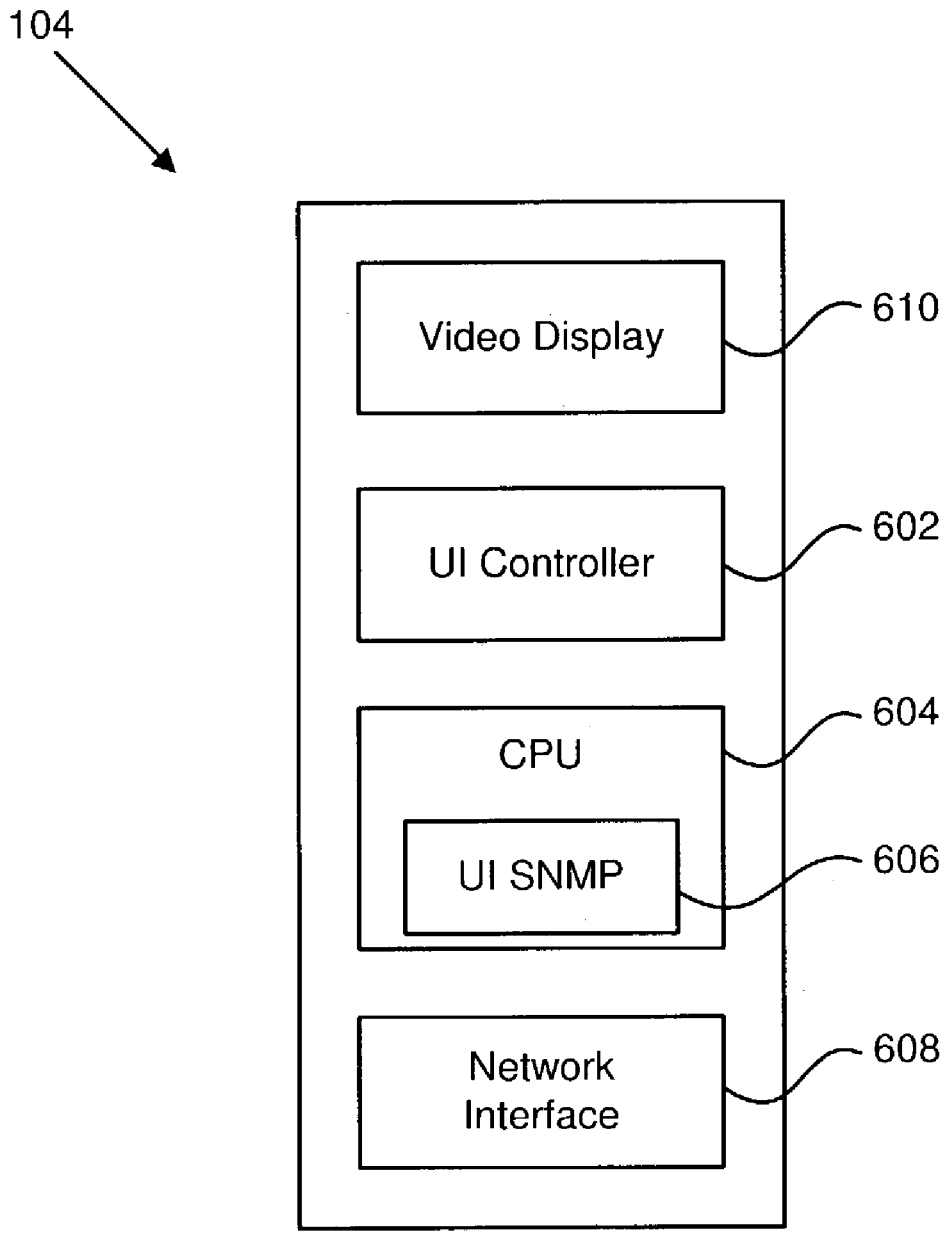
FIG. 6 is a schematic block diagram illustrating one embodiment of a user interface apparatus in accordance with the present invention.

Referring now to FIG. 6, shown therein is one embodiment of the user interface (UI) apparatus 104 for communicating with a vehicle 300 operated remotely over a network. The depicted UI apparatus 104 includes a UI controller 602, a CPU 604, a UI SNMP module 606, and a network interface connection 608. In one embodiment, the UI apparatus 104 may include a portable control device configured with a steering wheel controller, such as the Thrustmaster™ controller used for video games. In an alternative embodiment, the UI apparatus 104 may be configured in a manner patterned after traditional remote handheld controllers. The operator booth discussed above may also be used and provided with the appropriate actuators and sensors.

The UI controller 602 is preferably configured to convert vehicle control data 200 from the user into data recognizable by the CPU 604 and the UI SNMP module 606. In one embodiment of the present invention, the CPU 604 is configured to communicate with the UI controller 602, the UI SNMP module 606, and the network interface connection 608. The input received from the user through the UI controller 602 is configured by the CPU 604 and the UI SNMP module 606 in order to be transmitted by the network interface 608 to the vehicle 300 through a transmission medium (not shown).

In one embodiment, the transmission medium comprises a standard Ethernet network, which is familiar to one skilled in the art. In a further embodiment, the transmission medium may comprise a wireless peer-to-peer or infrastructure network. As discussed, any network protocol may be used as the transmission medium.

Figure 7:
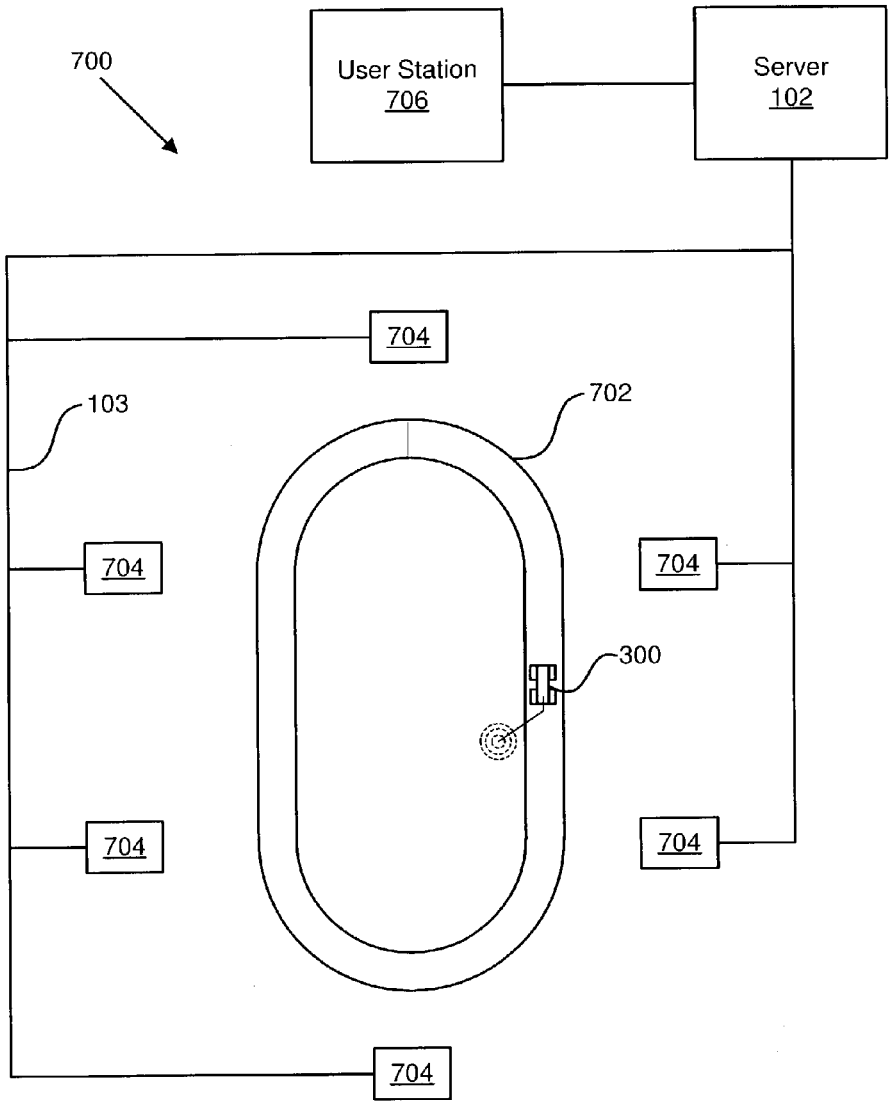
FIG. 7 is a schematic block diagram illustrating one embodiment of a network for computer controlled racing in accordance with the present invention.

FIG. 7 shows one embodiment of an implementation of the network 700 at a racing track 702. The vehicle 300 may be driven in an area such as the racetrack 702 that is provided with at least one transmitter/receiver 704 distributed around the racetrack 702 for the wireless transmission and reception to and from the vehicle 300. Such an implementation wherein a vehicle 300 communicates with a transmitter/receiver 704 in order to access the server 102 is known to those skilled in the art as an infrastructure implementation of a wireless network 700. Alternatively, the network 700 may be implemented in a peer-to-peer mode wherein the vehicle 300 transmits and receives vehicle control data directly from a user station 706.

In one embodiment, both audio/video signals and control signals are transmitted over the wireless data channels 103. For example, the audio, video, and control signals may be transmitted using the 802.11 standard or the Bluetooth standard. However, in alternative embodiments, the control signals may be transmitted with one protocol or transmission type and the audio and video signals with another. Alternatively, vehicle control data 200 may be embedded on a monaural channel of a video signal (i.e., in between the upper and lower channels). This signal then may be transmitted as the control signals of the vehicle 300. Control signals may also be transmitted from the vehicle 300 in addition to the audio and video data transmitted by the video camera module 302. Such signals may be used to generate a display, including in one embodiment a heads up display, for the user. Thus, gauges or other displays may show speed, fuel, oil pressure, temperature, etc.

Figure 8A:
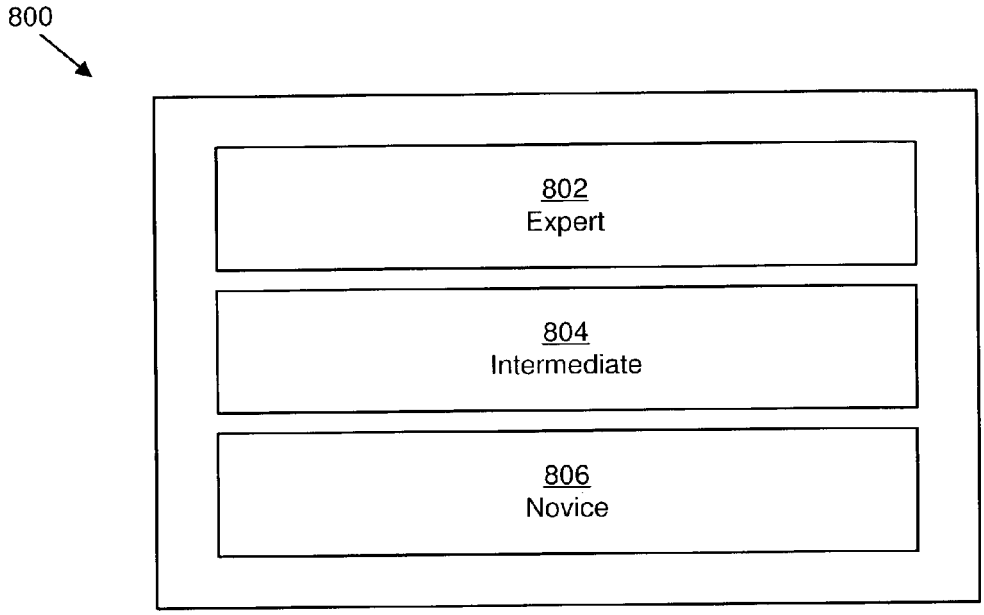
FIG. 8*a* is a schematic block diagram illustrating one embodiment of a racing bracket system in accordance with the present invention.

Referring now to FIG. 8*a*, shown therein is a schematic block diagram representing a racing bracket system 800 of the present invention. Users may be divided into an expert bracket 802, an intermediate bracket 804, and a novice bracket 806. Alternatively, the racing bracket system 800 may be implemented with any number of performance divisions. In one embodiment, a new user may be assigned to the novice bracket 806 and a performance level may be assigned to his or her vehicle 300 accordingly. For example, a user may graduate from the novice bracket 806 and advance to the intermediate bracket 804 upon winning a race or otherwise demonstrating sufficient performance control of the vehicle 300. In a similar manner, a user may advance to the expert bracket 802 and in one embodiment concurrently gain access to the full performance of the vehicle 300. Alternatively, advancement and other movement within the racing bracket system 800 may be determined on a point system.

Figure 8B:
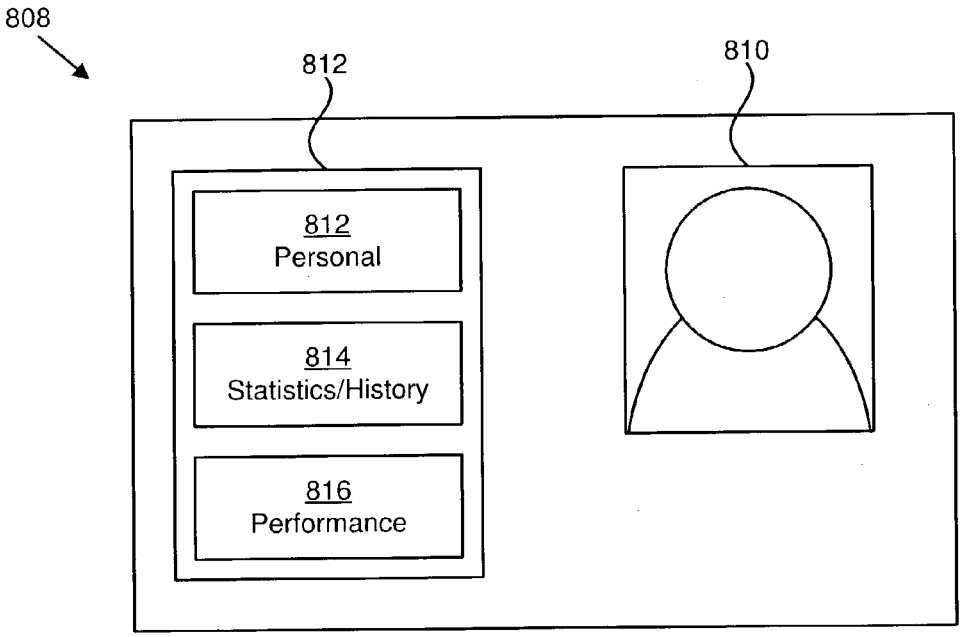
FIG. 8*b* is a schematic block diagram illustrating one embodiment of a user identification card in accordance with the present invention.

FIG. 8*b* is a schematic block diagram illustrating one embodiment of a user identification card (UIC) 808. In one embodiment, the UIC 808 illustrates a picture 810 of the user and a copy 812 of the user profile 116. The copy 812 of the user profile 116 may include all or part of the data stored in the user profile record 116 stored on the user profile database 114 and may include personal information 812, statistics/history 814, and an assigned performance level 816. The user profile copy 812 may be deployed on the UIC 808 in any number of manners. For example, in one embodiment the user profile copy 812 may reside within an embedded integrated circuit. In another embodiment, the user profile copy 812 may be visibly printed on the surface of the UIC 808. The statistics/history 814 may include, but is not limited to, win-loss history, laps lead during a race, and fastest speed. These factors may be used in one embodiment to determine the racing bracket 802, 804, 806 in which a user may race, as well as the assigned position within the starting lineup of a race.

Figure 9:
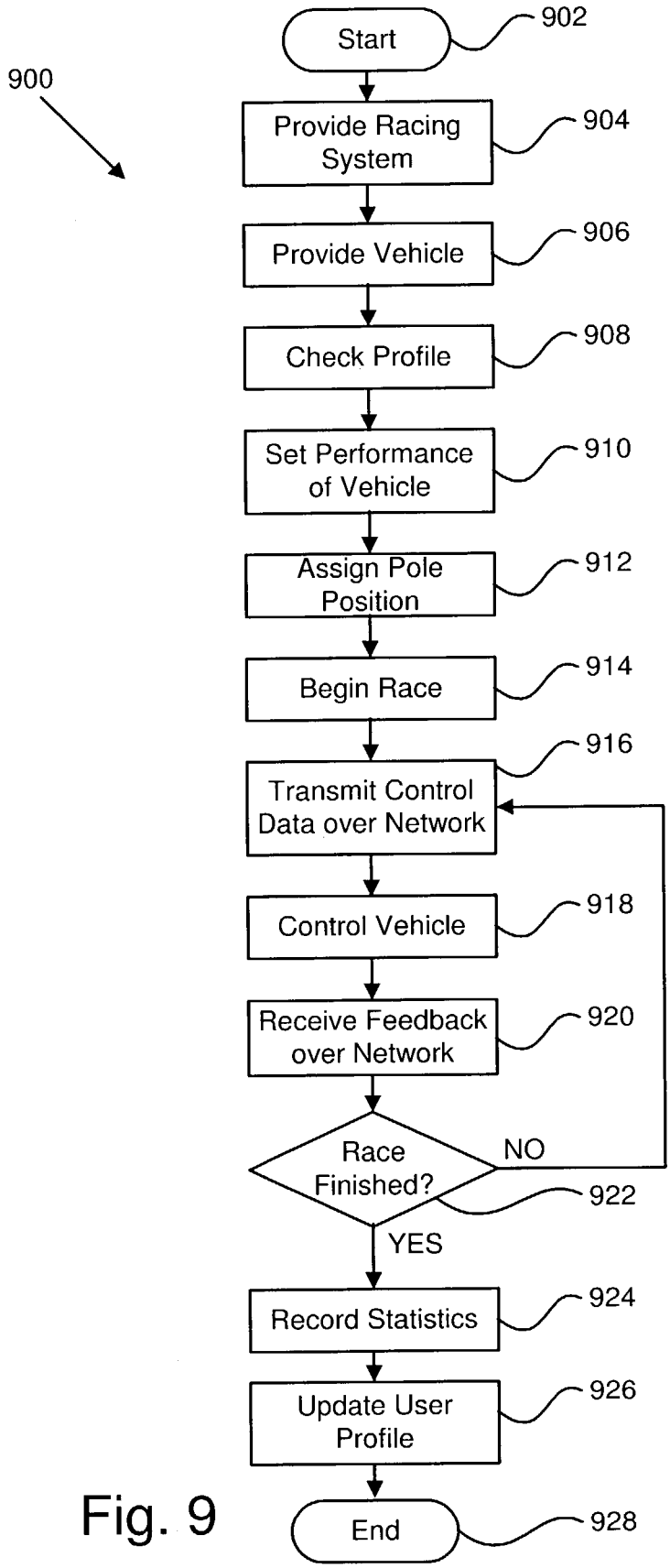
FIG. 9 is a flow chart diagram illustrating one embodiment of a method for computer controlled racing in accordance with the present invention.

Referring now to FIG. 9, shown therein is a method 900 of computer controlled racing over a network. The method 900 starts 902 and the racing system 100 is provided 904. In one embodiment, the racing system 100 may be provided 904 as a wired Ethernet network 100. In another embodiment, the network 100 may be wireless. Additionally, the vehicle 300 is provided 906 together with the corresponding vehicle control module 108 and the video camera module 302. Subsequently, the method 900 checks 908 the user profile 116 of the operator and the performance parameters of the vehicle 300 are set 910 according to the user's recorded or assigned performance level. In one embodiment, the user is then assigned a pole position 912 within the starting lineup of a race and the race begins 914.

As the user begins operating the vehicle 300, the associated vehicle control data 200 is transmitted 916 over the network 100. The vehicle control data 200 may be transmitted 916 wirelessly or through standard network data channels 103. The vehicle 300 receives the vehicle control data and the vehicle is controlled 918. Upon request from the user or an administrator, including an administrator application stored on the network 100, the vehicle 300 transmits feedback data, and the server 102 receives 920 the feedback data over the network 100. At a determined point within the communication sub-process between the server 102 and the vehicle control module 108, the method 900 determines 922 if the race is finished. If the race is not finished, then steps 916, 918, and 920 are continuously performed until the race is finished 922. In an alternate embodiment, the communication steps 916, 918, and 920 may be performed in parallel or in another order, instead of in succession as illustrated.

When the method 900 determines 922 that the race is finished, the server 102 records 924 the race statistics for the target user and the user profile record 116 is updated 926 as required. In one embodiment, updating 926 the user profile record 116 comprises updating the user profile database 114 and the user identification card 808. In a further embodiment, updating the user profile record 116 comprises updating the user's bracket designation 802, 804, 806. The depicted method 900 then ends 928.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for computer controlled racing over a network, the apparatus comprising:

a network interface connection configured to allow a server to communicate over a network;

the server configured to communicate control data with a central processing unit of a vehicle over the network; and a track marshal module operating within the server configured to override a user control signal with an administrator control signal in order to safely control the vehicle.

2. The racing system server of claim 1, further comprising a user profile database that is accessible by the server and configured to store a user profile record.

3. The racing system server of claim 2, wherein the user profile record comprises a user name, a user race history, a user skill level, and a vehicle performance profile.

4. The racing system server of claim 3, wherein the vehicle performance profile comprises an acceleration profile, a braking profile, a maximum speed profile, and a steering profile.

5. The racing system of server claim 1, the track marshal module further configured to dynamically adjust vehicle performance.

6. The racing system server of claim 1, further comprising a behavior module operating within the server and configured to assign a user profile to a vehicle.

7. The racing system of server claim 6, wherein the behavior module is further configured to assign the user vehicle to a position in a starting lineup of a race.

8. The racing system server of claim 6, wherein the behavior module is further configured to adjust a performance parameter of the vehicle according to an assigned skill level of the user.

9. A system for computer controlled racing over a network, the system comprising:

a network;

a vehicle configured to move about in response to vehicle control data from a user;

a central processing unit residing within a chassis configured to receive network switched packets containing the vehicle control data;

an actuator interface module configured to operate an actuator in response to the vehicle control data received by the controller;

a server configured to communicate with the central processing unit over the network; and a track marshal module operating within the server configured to override a user control signal with an administrator control signal in order to safely control the vehicle.

10. The system of claim 9, wherein the controller further comprises a wireless network interface connection.

11. The system of claim 9, wherein the controller is configured to transmit a 360° three dimensional view to the user.

12. A method of computer controlled racing over a network, the method comprising:

providing a vehicle configured to move about in response to vehicle control data from a user;

providing a server configured to communicate with a central processing unit of the vehicle over a network;

checking a user profile;

assigning a performance profile to the vehicle;

assigning a position to a user within the starting lineup of a plurality of racing vehicles;

transmitting vehicle control data;

controlling the mobile vehicle in response to the transmitted vehicle control data;

receiving vehicle feedback data from the vehicle;

recording racing statistics in a database;

updating a user identification card; and overriding a user control signal with an administrator control signal in order to safely control the vehicle.

13. The method of claim 12, wherein transmitting vehicle control data further comprises transmitting network switched packets.

14. The method of claim 12, wherein controlling the mobile vehicle further comprises controlling the mobile vehicle from within an operator booth.

15. The method of claim 12, wherein controlling the mobile vehicle further comprises controlling the mobile vehicle from a handheld control device.

16. The method of claim 12, wherein the vehicle feedback data comprises vehicle settings, the vehicle settings comprising speed, revolutions per minute (RPM), engine temperature, visual data, audible data, and the like.

17. The method of claim 12, further comprising calibrating vehicle performance settings to default values.

18. The method of claim 17, wherein the vehicle performance settings comprise accelerator response, maximum speed response, braking response, and steering response.

19. The method of claim 12, further comprising maintaining a user profile history.

20. The method of claim 12, further comprising adjusting vehicle performance settings according to the user profile history.

21. A computer usable medium readable by a computer, tangibly embodying a program of instructions executable by a computer to perform method steps for computer controlled racing over a network, said method steps comprising:

checking a user profile;

assigning a performance profile to the vehicle;

assigning a position to a user within the starting lineup of a plurality of racing vehicles;

transmitting vehicle control data;

controlling the mobile vehicle in response to the transmitted vehicle control data;

receiving vehicle feedback data from the vehicle;

recording racing statistics in a database;

updating a user identification card; and overriding a user control signal with an administrator control signal in order to safely control the vehicle.

* * * * *